US010399585B2

(12) United States Patent
Ren

(10) Patent No.: US 10,399,585 B2
(45) Date of Patent: Sep. 3, 2019

(54) METHOD OF CONTROLLING HYBRID OPERATION OF TRAINS HAVING DIFFERENT FORMATION LENGTHS AND COMMUNICATION-BASED TRAIN CONTROL SYSTEM

(71) Applicant: HUNAN CRRC TIMES SIGNAL & COMMUNICATION CO., LTD., Changsha, Hunan (CN)

(72) Inventor: Ying Ren, Hunan (CN)

(73) Assignee: HUNAN CRRC TIMES SIGNAL & COMMUNICATION CO., LTD., Changsha, Hunan (CN)

( * ) Notice: Subject to any disclaimer, the term of this patent is extended or adjusted under 35 U.S.C. 154(b) by 0 days.

(21) Appl. No.: 15/769,000

(22) PCT Filed: Oct. 21, 2016

(86) PCT No.: PCT/CN2016/102892
§ 371 (c)(1),
(2) Date: Apr. 17, 2018

(87) PCT Pub. No.: WO2017/067509
PCT Pub. Date: Apr. 27, 2017

(65) Prior Publication Data

US 2018/0281833 A1 Oct. 4, 2018

(30) Foreign Application Priority Data

Oct. 22, 2015 (CN) ..... 2015 1 0691460

(51) Int. Cl.
*B61L 1/00* (2006.01)
*B61L 23/34* (2006.01)
(Continued)

(52) U.S. Cl.
CPC ..... *B61L 27/0038* (2013.01); *B61L 1/00* (2013.01); *B61L 23/34* (2013.01);
(Continued)

(58) Field of Classification Search
CPC ..... B61L 27/0038; B61L 1/00; B61L 23/34; B61L 27/0061; B61L 27/0011; B61L 27/0077; B61L 27/04; B61L 2027/005
See application file for complete search history.

(56) References Cited

U.S. PATENT DOCUMENTS 7,657,349 B2 * 2/2010 Hawthorne ..... B61L 17/00 701/117
2009/0177344 A1 7/2009 James et al.
2016/0200327 A1 7/2016 Liu

FOREIGN PATENT DOCUMENTS

CN 101537841 A 9/2009
CN 103029723 A 4/2013
(Continued)

OTHER PUBLICATIONS

International Search Report for PCT/CN2016/102892, dated Jan. 20, 2017, ISA/CN.
(Continued)

*Primary Examiner* — Russell Frejd
(74) *Attorney, Agent, or Firm* — Yue (Robert) Xu; Apex Attorneys at Law, LLP

(57) ABSTRACT

A method of controlling hybrid operation of trains having different formation lengths and a communication-based train control (CBTC) system are provided. The method includes: before a train travels into a CBTC area, determining, according to a preset filter area, whether any other vehicle exists in front of the train in a travel direction thereof, if no other vehicle exists in front of the train in the travel direction thereof, determining a formation length of the train according to the filter area, determining, according to the formation
(Continued)

length of the train and the filter area, whether any other vehicle exists behind the train in the travel direction thereof, and if no other vehicle exists behind the train in the travel direction thereof, providing the train with a movement authorization.

10 Claims, 6 Drawing Sheets

(51) Int. Cl.
*B61L 27/00* (2006.01)
*B61L 27/04* (2006.01)

(52) U.S. Cl.
CPC ..... *B61L 27/0011* (2013.01); *B61L 27/0061* (2013.01); *B61L 27/0077* (2013.01); *B61L 27/04* (2013.01); *B61L 2027/005* (2013.01)

(56) References Cited

FOREIGN PATENT DOCUMENTS

| | | | |
|---|---|---|---|
| CN | 104554351 | A | 4/2015 |
| CN | 104760595 | A | 7/2015 |
| CN | 105292184 | A | 2/2016 |
| DE | 2124089 | A1 | 12/1972 |

OTHER PUBLICATIONS

Li, Xiuyan, "Process Analysis of Signal System Adopting CBTC Operation for Xi'an Subway Line 2", Northern Communications, No. 9, Sep. 30, 2011 (Sep. 30, 2011), ISSN: 1673-6052, pp. 57-59.
Chang, Yi, "Discussion on the Length and Location of the Transfer Track", Railway Signalling & Communication, vol. 47, No. 12, Dec. 31, 2011 (Dec. 31, 2011), ISSN: 1000-7458, pp. 25-27.
Chen, Yanbing, "Movement Authority of CBTC in Mixed Operation Mode",Railway Signalling & Communication, vol. 47, No. 8, Aug. 31, 2011 (Aug. 31, 2011), ISSN: 1000-7458, pp. 34-37.

* cited by examiner

METHOD OF CONTROLLING HYBRID OPERATION OF TRAINS HAVING DIFFERENT FORMATION LENGTHS AND COMMUNICATION-BASED TRAIN CONTROL SYSTEM

This application is a National phase application of PCT international patent application PCT/CN2016/102892, filed on Oct. 21, 2016 which claims the priority to Chinese Patent Application No. 201510691460.8, titled "CONTROL METHOD FOR HYBRID RUNNING OF TRAINS WITH DIFFERENT MARSHALLING LENGTHS AND COMMUNICATION BASED TRAIN CONTROL SYSTEM" and filed with the Chinese State Intellectual Property Office on Oct. 22, 2015, both of which are incorporated herein by reference in their entireties.

FIELD

The present disclosure relates to the technical field of control, and particularly to a control method for hybrid running of trains with different marshalling lengths and a communication based train control system.

BACKGROUND

With rapid development of communication technology, particularly radio technology, a train running control system based on communication technology is researched increasingly deeply, and a Communication Based Train Control System (CBTC system) emerges accordingly. The CBTC system is a control system for realizing safety protection of the train based on the bidirectional train-to-ground wireless communication technology and the moving block control principle. The CBTC system is used for replacing the track circuit as a medium to realize running control of the train. The CBTC system is increasingly widely applied to train running safety protection of urban rail transit.

Only if the CBTC system recognizes the marshalling length of a train entering into a CBTC control area and determines that no vehicle (e.g., a track engineering maintenance vehicle) exists in a safety range in front of/in the rear of the train, the CBTC system provides movement authorization for the train. That is, the CBTC system transmits a safe running direction, a safe running distance and other information calculated accurately to the train. In the existing CBTC system, a transfer track is generally provided at the boundary (such as a connecting line between a departure line and other lines) of the CBTC control area, and a trackside CBTC device is provided beside the transfer track. The trackside CBTC device receives information reported by an on-board CBTC device of the train entering into the CBTC control area, and parses the received information to obtain the marshalling length of the train. The trackside CBTC device transmits movement authorization to the on-board CBTC device only in a case of determining the marshalling length of the train and determining that no vehicle exists in the safety range in front of/in the rear of the train.

Since different trains usually have multiple different marshalling lengths such as six compartments or eight compartments, hybrid running of trains with different marshalling lengths is to be realized in a running line of the train. The existing CBTC system has to quickly determine whether a vehicle exists in a safety range in front of/in the rear of the train, in order to timely provide the movement authorization for the train. Therefore, only one type of train with the fixed marshalling length can run in the same running line generally, which limits the hybrid running of trains with different marshalling lengths.

SUMMARY

A control method for hybrid running of trains with different marshalling lengths and a CBTC system are provided according to the embodiments of the present disclosure, so as to not only provide a movement authorization for the train timely and quickly, but also support the hybrid running of the trains with different marshalling lengths.

In order to solve the above technical problem, the following technical solutions are provided according to the embodiments of the present disclosure.

A control method for hybrid running of trains with different marshalling lengths is provided. The method includes the following steps. It is determined whether other vehicle exists in front of a train in a running direction of the train based on a preset screening area, before the train runs into a communication based train control CBTC area. A marshalling length of the train is determined based on the screening area in a case where no vehicle exists in front of the train in the running direction of the train. It is determined whether other vehicle exists in the rear of the train in the running direction of the train based on the marshalling length of the train and the screening area. Movement authorization is provided for the train in a case where no vehicle exists in the rear of the train in the running direction of the train.

The screening area is set as follows. At least one marshalling length and a minimum train running length which are allowed in a running line of the train are determined, and the screening area is set in the running line based on the at least one marshalling length and the minimum train running length. The screening area adjoins the CBTC area, at least one screening section respectively matching with the at least one marshalling length is set in the screening area, and each of the at least screening section starts from an axle counting magnetic head located at an adjoining position where the screening area adjoins the CBTC area.

The determining whether other vehicle exists in front of the train in the running direction of the train based on the preset screening area includes: receiving a locomotive position transmitted by an on-board CBTC device of the train and calculating a distance between the locomotive and the axle counting magnetic head; determining whether other vehicle exists in a train front section adjoining the screening area in the CBTC area, in a case where the distance between the locomotive and the axle counting magnetic head is less than or equal to the minimum train running length; and determining that other vehicle exists in front of the train in the running direction of the train in a case where other vehicle exists in the train front section, and determining that no vehicle exists in front of the train in the running direction of the train in a case where no vehicle exists in the train front section.

The determining the marshalling length of the train based on the screening area includes: receiving marshalling length information transmitted by an on-board CBTC device of the train; collecting section length information of the screening section matching with a length of the train after the whole train enters into the screening area; and determining whether the marshalling length information matches with the section length information, and determining the marshalling length of the train based on the marshalling length information in a case where the marshalling length information matches with the section length information.

The determining whether other vehicle exists in the rear of the train in the running direction of the train based on the marshalling length of the train and the screening area includes: after the whole train enters into the screening area, determining the screening section matching with the marshalling length of the train in the screening area, and setting a train rear section in the rear of the determined screening section, where a length of the train rear section is equal to the minimum train running length; determining whether other vehicle exists in the train rear section; determining that other vehicle exists in the rear of the train in the running direction of the train in a case where other vehicle exists in the train rear section, and determining that no vehicle exists in the rear of the train in the running direction of the train in a case where no vehicle exists in the train rear section.

A communication based train control CBTC system is provided. The CBTC system includes: a first judging module, a determining module and a second judging module. The first judging module is configured to determine whether other vehicle exists in front of a train in a running direction of the train based on a screening area preset by a setting module, before the train runs into a communication based train control CBTC area. The determining module is configured to determine a marshalling length of the train based on the screening area in a case where no vehicle exists in front of the train in the running direction of the train. The second judging module is configured to determine whether other vehicle exists in the rear of the train in the running direction of the train based on the marshalling length of the train and the screening area, and provide movement authorization for the train in a case where no vehicle exists in the rear of the train in the running direction of the train.

The setting module includes: a determining unit and a setting unit. The determining unit is configured to determine at least one marshalling length and a minimum train running length which are allowed in a running line of the train. The setting unit is configured to set the screening area in the running line based on the at least one marshalling length and the minimum train running length. The screening area adjoins the CBTC area, at least one screening section respectively matching with the at least one marshalling length is set in the screening area, and each of the at least one screening section starts from an axle counting magnetic head located at an adjoining position where the screening area adjoins the CBTC area.

The first judging module includes: a calculating unit and a first judging unit. The calculating unit is configured to receive a locomotive position transmitted by an on-board CBTC device of the train, and calculate a distance between the locomotive and the axle counting magnetic head. The first judging unit is configured to determine whether other vehicle exists in a train front section adjoining the screening area in the CBTC area in a case where a distance between the locomotive and the axle counting magnetic head is less than or equal to the minimum train running length, determine that other vehicle exists in front of the train in the running direction of the train in a case where other vehicle exists in the train front section, and determine that no vehicle exists in front of the train in the running direction of the train in a case where no vehicle exists in the train front section.

The determining module includes: a receiving unit, a collecting unit and a matching unit. The receiving unit is configured to receive marshalling length information transmitted by an on-board CBTC device of the train. The collecting unit is configured to collect section length information of the screening section matching with a length of the train after the whole train enters into the screening area. The matching unit is configured to determine whether the marshalling length information matches with the section length information, and determine the marshalling length of the train based on the marshalling length information in a case where the marshalling length information matches with the section length information.

The second judging module includes: a setup unit and a second judging unit. The setup unit is configured to, after the whole train enters into the screening area, determine a screening section matching with the marshalling length of the train in the screening area, and set a train rear section in the rear of the determined screening section. A length of the train rear section is equal to the minimum train running length. The second judging unit is configured to determine whether other vehicle exists in the train rear section, determine that other vehicle exists in the rear of the train in the running direction of the train in a case where other vehicle exists in the train rear section, and determine that no vehicle exists in the rear of the train in the running direction of the train in a case where no vehicle exists in the train rear section.

As described above, the control method for hybrid running of trains with different marshalling lengths and the CBTC system are provided in the present disclosure. It is determined whether other vehicle exists in front of a train in a running direction of the train based on a preset screening area before the train runs into a communication based train control CBTC area. The marshalling length of the train is determined based on the screening area in a case where no vehicle exists in front of the train in the running direction of the train. It is determined whether other vehicle exists in the rear of the train in the running direction of the train based on the marshalling length of the train and the screening area. Movement authorization is provided for the train in a case where no vehicle exists in the rear of the train in the running direction of the train. It can be seen that, with the technical solution in the present disclosure, it is determined whether other vehicle exists in front of a train in a running direction of the train based on the set screening area before the trains with different marshalling lengths run into the CBTC area, the marshalling length of the train is determined based on the screening area, and it is determined whether other vehicle exists in the rear of the train in the running direction of the train, thereby not only providing movement authorization for the train timely and quickly, but also supporting hybrid running of trains with different marshalling lengths, which can widen an application scope of the CBTC system.

BRIEF DESCRIPTION OF THE DRAWINGS

In order to more clearly illustrate technical solutions of the embodiments of the present disclosure or the conventional technology, the drawings required in the description of the embodiments or the conventional technology are briefly described below. Apparently, the drawings are only some embodiments of the present disclosure, and other drawings may be acquired by those skilled in the art based on the drawings provided herein without any creative work.

DETAILED DESCRIPTION

Figure 1:
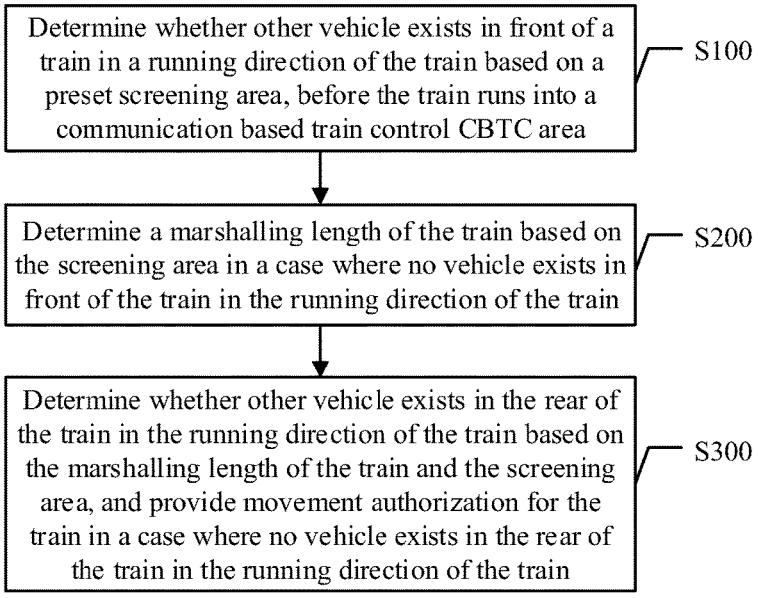
FIG. 1 is a schematic flowchart of a control method for hybrid running of trains with different marshalling lengths according to an embodiment of the present disclosure.

Related technical terms are explained as follows.

CBTC, Communication Based Train Control, refers to a communication based train control system. The control system is a continuous automatic train control system constructed through an on-board processor and a ground processer which may perform a safety function by utilizing the active train positioning technology independent from a trackside train occupancy detecting device and the continuous bidirectional train-to-ground data communication technology, and is used to control a speed of the train based on a high-capacity, continuous bidirectional train-to-ground information communications and the train positioning and control technology.

An accident refers to an event which is undesirable to happen, is unforeseen and may result in death, injury or property damage. The accident is a dynamic process, which begins with a harmful action, includes a series of events throughout the system, and results in an unexpected result in a certain order.

Train running front is explained as follows: in a case where point B is in front of point A in a running direction of the train, B is called as running front of A.

Train running rear is explained as follows: in a case where point B is in front of point A in a running direction of the train, A is called as running rear of B.

Occupancy refers to that a track section is occupied by the train currently.

Back up refers to that the train moves in a case that the driver is not in the locomotive.

Movement authorization refers to authorization to allow the train to enter into a specific area in a given running direction and run in the specific area. The movement authorization is provided in consideration of information on various dangerous points in train running front, and ensures that normal movement of the train in an authorization range is not limited. The end for the movement authorization range should not go beyond the dangerous point.

An axle counter is also called as a microcomputer axle counter, which is a device installed at stations of two ends of the railway. A closed-loop sensor installed on the track is used to monitor the number of wheel pairs of the train which passes the track, and the number of wheel pairs at the current station is transmitted to the other station through a semiautomatic device after AND gate detection of a microcomputer system installed indoors is performed. After the train arrives at the other station, a section is unblocked automatically in a case where the number of the wheel pairs received by the other station is same as the number of the wheel pairs at the departure station. That is, the axle counter is a railway signal device which can detect passing of wheels, and may replace multiple normal track circuits.

An axle counting magnetic head is explained as follows. A counting head (or a detection point) is installed at each end of a track section. Each section is provided with an electronic counter which is implemented by a computer and is associated with the detection point of the each end of the section. A detection point includes two independent sensors. The detection point can detect a running direction of the train based on an order in which the sensors are passed. As each wheel pair passes the detection point at the start of the track section, a counter of the section increases. As the train passes a similar detection point at the end of the track section, the counter of the section decreases.

Train marshalling refers to the number of compartments of the train, that is, the number of compartments of a metro vehicle.

In order to make the objectives, the features and the advantages of the present disclosure clearer and easily be understood, the technical solutions according to the embodiments of the present disclosure will be described clearly and completely hereinafter in conjunction with the drawings in the embodiments of the present disclosure. Apparently, the described embodiments are only a part rather than all of embodiments of the present disclosure. Any other embodiments acquired by those skilled in the art based on the embodiments of the present disclosure without any creative work fall in the protection scope of the present disclosure.

FIG. 1 is a schematic flowchart of a control method for hybrid running of trains with different marshalling lengths according to an embodiment of the present disclosure.

As shown in FIG. 1, the control method for hybrid running of trains with different marshalling lengths according to the embodiment of the present disclosure includes steps S100 to S300.

In step S100, it is determined whether other vehicle exists in front of a train in a running direction of the train based on a preset screening area, before the train runs into a communication based train control CBTC area.

In the embodiment of the present disclosure, setting of the screening area may include: determining at least one marshalling length and a minimum train running length which are allowed in a running line of the train; and setting the screening area in the running line based on the at least one marshalling length and the minimum train running length. The screening area adjoins the CBTC area. At least one screening section respectively matching with the at least one marshalling length is set in the screening area. Each of the at least one screening section starts from an axle counting magnetic head located at an adjoining position where the screening area adjoins the CBTC area, and a position of an axle counting magnetic head at an ending point of the screening section is set based on the marshalling length.

Figure 2:
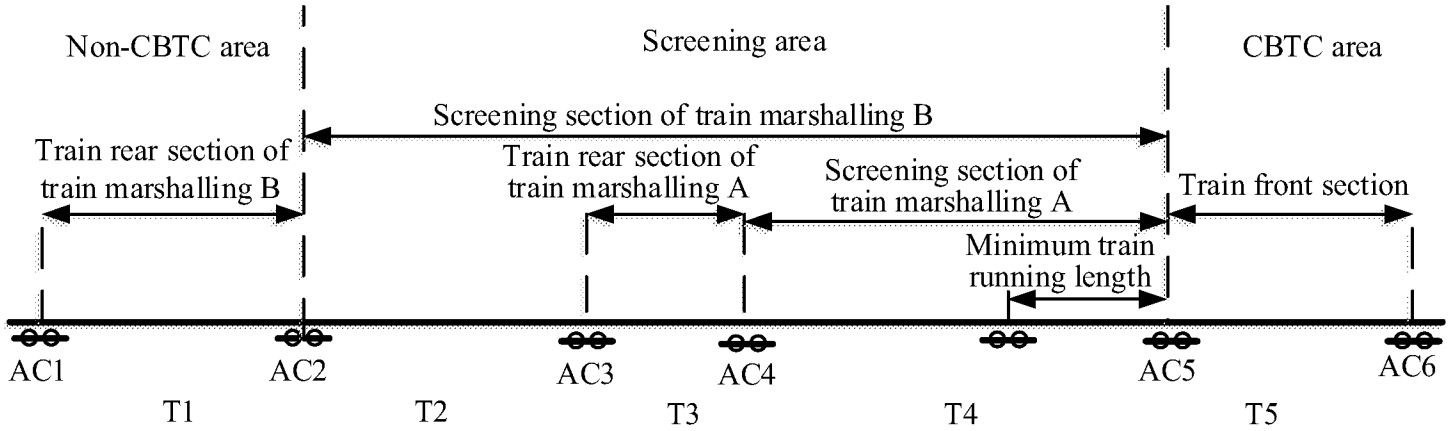
FIG. 2 is a schematic diagram showing a screening area set according to an embodiment of the present disclosure.

The screening area is set as shown in FIG. 2, which is a schematic diagram of a screening area set according to the embodiment of the present disclosure.

Firstly, the marshalling length of a running train and the minimum train running length which are allowed in the line are determined. Secondly, a fixed screening area is set at a transfer track or a connecting line based on the marshalling length of the train and the minimum train running length in the line. Thirdly, multiple screening sections are set in the screening area along a direction in which the train enters into the CBTC area based on the lengths of trains with the different marshalling lengths, with stating from the axle counting magnetic head located at the adjoining position where the screening area adjoins the CBTC area.

In setting multiple screening sections, the length of the transfer track or the connecting line may be set based on the maximum marshalling length in the line. For example, the length of the transfer track or the connecting line may be set as the length of the screening area, which is the length of a maximum screening section in the screening area.

Multiple fixed screening sections are set respectively based on the multiple marshalling lengths of the trains running in the line (for example, two screening sections with different lengths are set in a case that there are two trains with different marshalling lengths in the line). Multiple screening sections are started from the axle counting magnetic head located at a boundary between the transfer track/the connecting line and the CBTC area. A position of the axle counting magnetic head at the end of the screening section is set based on the marshalling length corresponding to the screening section (for example, the transfer track or the connecting line may be set as the screening section corresponding to the maximum marshalling length).

With reference to FIG. 2, it is assumed that there are two train marshalling manners for the line, which includes marshalling of three compartments (or the length of the train is 60 meters) and marshalling of six compartments (or the length of the train is 120 meters). The minimum train running length allowed in the line is 25 meters based on an operation requirement.

All screening sections are started from the axle counting magnetic head (AC5 axle counting magnetic head) located at the boundary between the screening area (the transfer track/the connecting line) and the CBTC area, and the screening sections are set as follows.

The screening section for the train marshalling A is set as shown in FIG. 2 (T4 section), and the marshalling length (60 meters) of three compartments is set as the length of the section.

The screening section for the train marshalling B is set as shown in FIG. 2 (T2+T3+T4 sections), and the marshalling length (120 meters) of six compartments is set as the length of the section.

In step S200, the marshalling length of the train is determined based on the screening area in a case where no vehicle exists in front of the train in the running direction of the train.

In the embodiment of the present disclosure, it can be determined whether other vehicle exists in front of the train in the running direction of the train based on the axle counting magnetic head in the screening area. In a case where other vehicle exists in front of the train in the running direction of the train, a rear-end accident or a collision accident may occur if the train continues moving forward. In this case, the CBTC does not provide movement authorization for the train.

In a case where no vehicle exists in front of the train in the running direction of the train, a distance between the axle counting magnetic head at the tail of the train and the axle counting magnetic head at the locomotive of the train is the marshalling length of the train when the locomotive of the train arrives at the axle counting magnetic head located at the adjoining position where the screening area adjoins the CBTC area.

In step S300, it is determined whether other vehicle exists in the rear of the train in the running direction of the train based on the marshalling length of the train and the screening area, and movement authorization is provided for the train in a case where no vehicle exists in the rear of the train in the running direction of the train.

In the embodiment of the present disclosure, after the marshalling length of the train is determined, it may be determined whether other vehicle exists in the rear of the train in the running direction of the train based on a section (which is a screening section with the longer length than the marshalling length of the train) in the rear of the axle counting magnetic head at the tail of the train in the screening area. In a case where other vehicle exists in the rear of the train in the running direction of the train, a rear-end accident or a collision accident may occur if the train backs up. In this case, the CBTC does not provide movement authorization for the train.

The control method for hybrid running of trains with different marshalling lengths is provided according to the embodiment of the present disclosure. It is determined whether other vehicle exists in front of a train in a running direction of the train based on a preset screening area before the train runs into a communication based train control CBTC area. The marshalling length of the train is determined based on the screening area in a case where no vehicle exists in front of the train in the running direction of the train. It is determined whether other vehicle exists in the rear of the train in the running direction of the train based on the marshalling length of the train and the screening area, and movement authorization is provided for the train in a case where no vehicle exists in the rear of the train in the running direction of the train. It can be seen that, with the technical solution in the present disclosure, it is determined whether other vehicle exists in front of the train in the running direction of the train based on the set screening area before the trains with different marshalling lengths run into the CBTC area, the marshalling length of the train is determined based on the screening area, and it is determined whether other vehicle exists in the rear of the train in the running direction of the train, thereby providing movement authorization for the train timely and quickly, but also supporting hybrid running of trains with different marshalling lengths, which can widen an application scope of the CBTC system.

Figure 3:
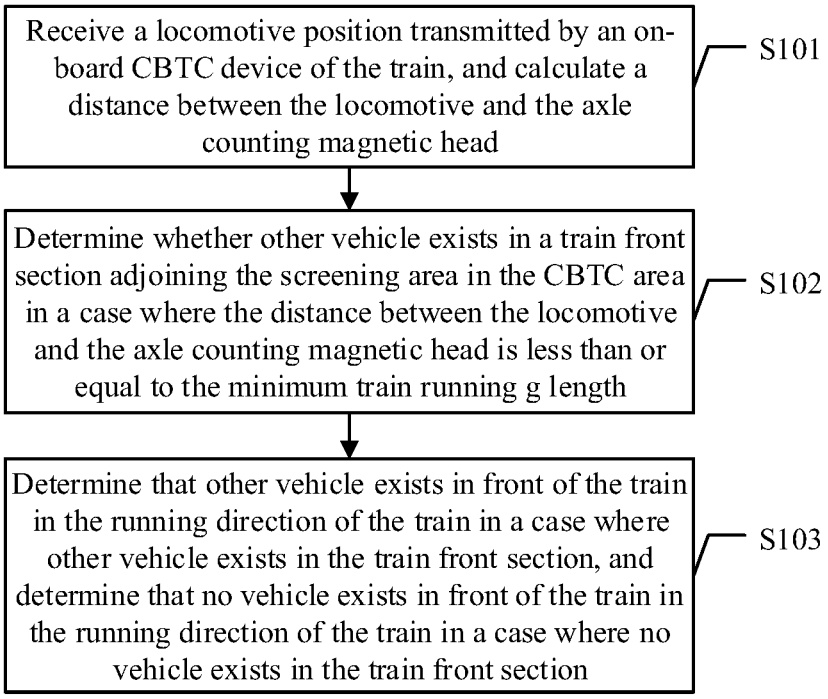
FIG. 3 is a schematic flowchart of a control method for hybrid running of trains with different marshalling lengths according to another embodiment of the present disclosure.

FIG. 3 is a schematic flowchart of a control method for hybrid running of trains with different marshalling lengths according to another embodiment of the present disclosure.

With reference to FIG. 3, based on the above embodiment, in the control method for hybrid running of trains with different marshalling lengths according to the embodiment of the present disclosure, the determining whether other vehicle exists in front of the train in the running direction of the train based on the preset screening area includes steps S101 to S103.

In step S101, a locomotive position transmitted by an on-board CBTC device of the train is received, and a distance between the locomotive and the axle counting magnetic head is calculated.

In step S102, it is determined whether other vehicle exists in a train front section adjoining the screening area in the CBTC area in a case where the distance between the locomotive and the axle counting magnetic head is less than or equal to the minimum train running length.

In step S103, it is determined that other vehicle exists in front of the train in the running direction of the train in a case where other vehicle exists in the train front section, and it is determined that no vehicle exists in front of the train in the running direction of the train in a case where no vehicle exists in the train front section.

In the embodiment of the present disclosure, it is required to make sure that no vehicle exists in front of the train in the running direction of the train, which may be called as front screening processing. The front screening processing is performed to make sure that no vehicle exists in front of the train in the running direction of the train. In a case where the positioned train enters into the screening area, the distance between the locomotive position of the train reported by the on-board CBTC device and the axle counting magnetic head at the boundary between the CBTC area and the screening area, i.e., the transfer track or the connecting line, is less than the minimum train running length allowed in the line, and the train front section is in an idle state (no vehicle occupies the train front section), it may be determined that no vehicle exists in front of the train in the running direction of the train, and a next step is performed. For example, in a case where other vehicle exists in the train front section, no movement authorization may be provided for the train.

With reference to FIG. 2, in the embodiment of the present disclosure, a first axle counting section (an axle counting section starting from the axle counting magnetic head at the boundary between the screening area, i.e., the transfer track/the connecting line, and the CBTC area) in the CBTC area functions as the train front section (a section T5).

In a case where the distance between the locomotive and the axle counting magnetic head is less than or equal to the minimum train running length, a section between the locomotive and the axle counting magnetic head is not large enough for a train with the minimum train running length. That is, neither the train with the minimum train running length nor other vehicle exists in the section. In this case, if no vehicle exists in the train front section adjoining the screening area in the CBTC area, it can be determined that no vehicle exists in front of the train in the running direction of the train.

In the conventional technology, a vehicle in front of the train may not be provided with an on-board CBTC device, and thus the vehicle is unable to report its information to the trackside CBTC device, which results in that the trackside CBTC device cannot find the vehicle in front of the train.

In the embodiment of the present disclosure, it is determined whether a train with the minimum train running length allowed in the line exists in front of the train based on the screening area before the train enters into the CBTC area, and it is determined whether other vehicle exists in train front section by the CBTC. Therefore, it is determined whether other vehicle exists in front of the train quickly. In this way, no matter whether the vehicle in front of the train is provided with the on-board CBTC device, the vehicle can be detected, thereby further improving the safety of controlling train running.

Figure 4:
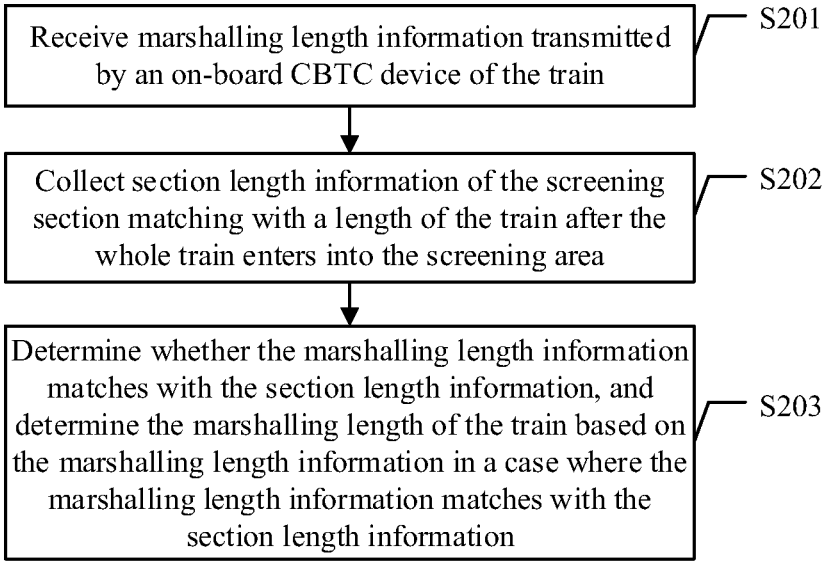
FIG. 4 is a schematic flowchart of a control method for hybrid running of trains with different marshalling lengths according to another embodiment of the present disclosure.

FIG. 4 is a schematic flowchart of a control method for hybrid running of trains with different marshalling lengths according to another embodiment of the present disclosure.

With reference to FIG. 4, based on the above embodiment, in the control method for hybrid running of trains with different marshalling lengths according to the embodiment of the present disclosure, the determining the marshalling length of the train based on the screening area includes steps S201 to S203.

In step S201, marshalling length information transmitted by the on-board CBTC device of the train is received.

In step S202, section length information of a screening section matching with the length of the train is collected after the whole train enters into the screening area.

In a case that the locomotive of the train is exactly located at the axle counting magnetic head at the adjoining position where the screening area adjoins the CBTC area, length information of a screening section between the axle counting magnetic head at the locomotive of the train and an axle counting magnetic head at the tail of the train is the collected section length information of the screening section matching with the length of the train.

In step S203, it is determined whether the marshalling length information matches with the section length information, and the marshalling length of the train is determined based on the marshalling length information in a case where the marshalling length information matches with the section length information.

In the embodiment of the present disclosure, in determining the marshalling length of the train, the marshalling length of the train may be acquired directly from the on-board CBTC device, or the section length information of the screening section matching with the length of the train collected in the screening area may function as the marshalling length of the train. In order to prevent inaccurate marshalling length from being stored in the on-board CBTC device, preferably, the section length information of the screening section matching with the length of the train collected in the screening area functions as the marshalling length of the train in the embodiment of the present disclosure.

In addition, in order to prevent inaccurate marshalling length from being stored in the on-board CBTC device, it may be determined whether the marshalling length stored in the on-board CBTC device is accurate in the embodiment of the present disclosure. The trackside CBTC device may acquire a locomotive position/a tail position or the marshalling length information of the train reported by the on-board CBTC device. After it is determined that the whole train enters into the screening area in a case where a distance between the locomotive and the axle counting magnetic head at the boundary is less than a preset value (which is set based on a distance between the top of a train coupler and wheel pairs in engineering), the trackside CBTC device compares the marshalling length information with the collected section length information of the screening section matching with the length of the train, that is, length information of a screening area occupied for the marshalling length of the train, to determine whether the locomotive position/the tail position or the marshalling length information of the train reported by the on-board CBTC device is accurate.

In a case where it is determined that the marshalling length information reported by the on-board CBTC device is consistent with the collected section length information of the screening section matching with the length of the train, a next step may be performed. In a case where it is determined that the marshalling length information reported by the on-board CBTC device is not consistent with the collected section length information of the screening section matching with the length of the train, movement authorization may be provided for the train based on the section length information of the screening section matching with the length of the train; or no movement authorization is provided for the train, alternatively, instruction information is transmitted to the train to remind that the marshalling length information stored in the on-board CBTC device is not accurate.

In the technical solution according to the embodiment of the present disclosure, the marshalling length of the train can be determined based on the screening area, and it is determined whether the marshalling length information of the train stored in the on-board CBTC device is accurate based on the marshalling length of the train determined based on the screening area, which makes sure that a running direction, a running distance and other information transmitted in movement authorization provided for the train based on the collected marshalling length of the train meet the actual situation, thereby avoiding an accident such as a collision accident and a rear-end accident from occurring in the train caused by incorrect information provided by the on-board CBTC device and reducing safety hidden danger.

Figure 5:
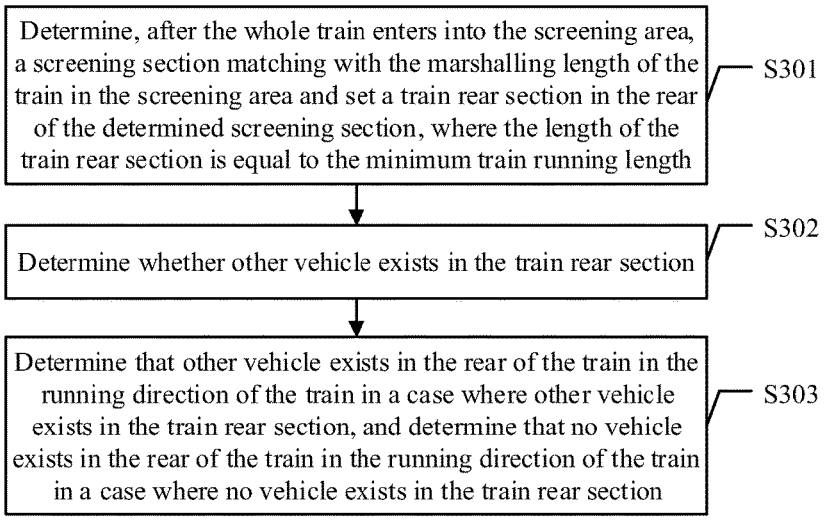
FIG. 5 is a schematic flowchart of a control method for hybrid running of trains with different marshalling lengths according to another embodiment of the present disclosure.

FIG. 5 is a schematic flowchart of a control method for hybrid running of trains with different marshalling lengths according to another embodiment of the present disclosure.

With reference to FIG. 5, based on the above embodiment, in the control method for hybrid running of trains with different marshalling lengths according to the embodiment of the present disclosure, the process of determining whether other vehicle exists in the rear of the train in the running direction of the train based on the marshalling length of the train and the screening area includes steps S301 to S303.

In step S301, after the whole train enters into the screening area, a screening section matching with the marshalling length of the train is determined in the screening area, and a train rear section is set in the rear of the determined screening section. The length of the train rear section is equal to the minimum train running length.

In step S302, it is determined whether other vehicle exists in the train rear section.

In step S303, it is determined that other vehicle exists in the rear of the train in the running direction of the train in a case where other vehicle exists in the train rear section, and it is determined that no vehicle exists in the rear of the train in the running direction of the train in a case where no vehicle exists in the train rear section.

In the embodiment of the present disclosure, it is required to make sure that no vehicle exists in the rear of the train in the running direction of the train, which may be called as rear screening processing. The rear screening processing is used to make sure that no vehicle exists in the rear of the train in the running direction of the train. In a case where information reported by the on-board CBTC device indicates that the positioned train entirely enters into the screening area, and the train rear section is in an idle state (no vehicle occupies the train rear section), it can be determined that no vehicle exists in the rear of the train in the running direction of the train, and a next step may be performed. In a case where other vehicle exists in the train rear section, no movement authorization is provided for the train.

With reference to FIG. 2, in the embodiment of the present disclosure, a train rear section (a section T3) for short marshalling (the train marshalling A) is set in the rear of the screening section corresponding to the short marshalling length (the train marshalling A) based on the minimum train length (25 meters) allowed in the line, to avoid the train with the minimum train length from existing in the rear of the train with short marshalling (the train marshalling A). A non-CBTC area is provided in the rear of the screening section corresponding to the longest marshalling length (the train marshalling B). A section (an axle counting section starting from an axle counting magnetic head at the boundary between the screening area, i.e., the transfer track/the connecting line, and the non-CBTC area) starting from a first axle counting magnetic head in the non-CBTC area may function as a train rear section (a T1 section) for long marshalling (the train marshalling B).

A train with the minimum train running length is not allowed to exist in the train rear section for the short marshalling (the train marshalling A), that is, in the rear of the screening section corresponding to the short marshalling length (the train marshalling A). That is, the train with the minimum running length does not exist, and other vehicles may also not exist. Therefore, it may be considered that no vehicle exists in the rear of the train with short marshalling in the running direction of the train. In a case where no vehicle exists in the rear of the screening section corresponding to the longest marshalling length (the train marshalling B), that is, in the train rear section for long marshalling (the train marshalling B), it may be considered that no vehicle exists in the rear of the train with long marshalling (the train marshalling B) in the running direction of the train.

In the conventional technology, a vehicle in the rear of the train may not be provided with the on-board CBTC device, and thus the vehicle is unable to report its information to the trackside CBTC device, which results in that the trackside CBTC device cannot find the vehicle in the rear of the train.

In the embodiment of the present disclosure, it is determined whether a train with the minimum train running length allowed in the line exists in the rear of the train with short marshalling (the train marshalling A) or whether other vehicle exists in the rear of the train with long marshalling (the train marshalling B) through the screening area after the whole train enters into the screening area. In this way, it can be determined whether other vehicle exists in the rear of the train quickly, and the vehicle in the rear of the train can be detected no matter whether the vehicle is provided with the on-board CBTC device, thereby further improving the safety of controlling train running.

Figure 6:
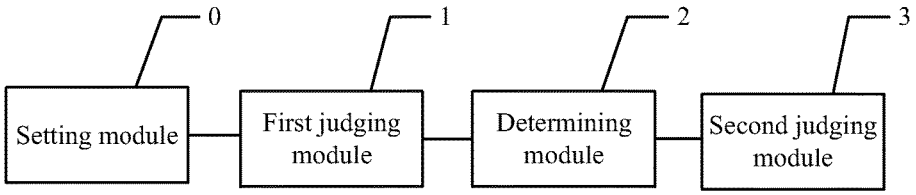
FIG. 6 is a schematic structural diagram of a communication based train control CBTC system according to the present disclosure.

FIG. 6 is a schematic structural diagram of a communication based train control CBTC system according to the present disclosure.

With reference to FIG. 6, a CBTC system according to the present disclosure includes a setting module 0, a first judging module 1, a determining module 2 and a second judging module 3.

The setting module 0 is configured to preset a screening area for a communication based train control CBTC area.

The first judging module 1 is configured to determine whether other vehicle exists in front of a train in a running direction of the train based on the screening area preset by the setting module, before the train runs into the CBTC area.

The determining module 2 is configured to determine a marshalling length of the train based on the screening area in a case where no vehicle exists in front of the train in the running direction of the train.

The second judging module 3 is configured to determine whether other vehicle exists in the rear of the train in the running direction of the train based on the marshalling length of the train and the screening area, and provide movement authorization for the train in a case where no vehicle exists in the rear of the train in the running direction of the train.

Figure 7:
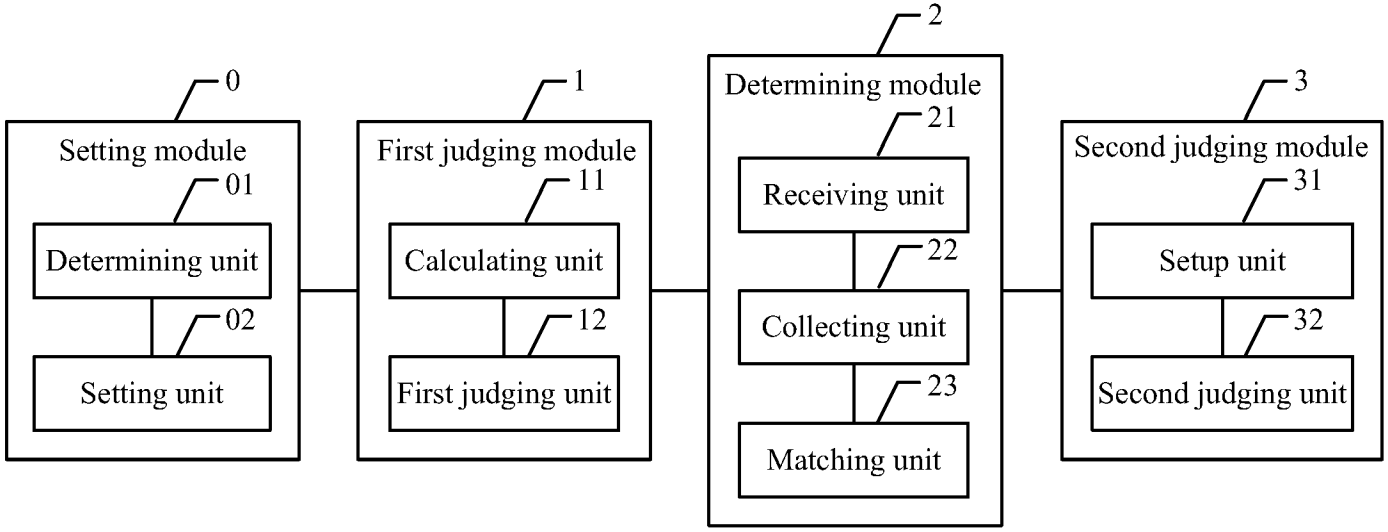
FIG. 7 is a schematic structural diagram of another communication based train control CBTC system according to the present disclosure.

FIG. 7 is a schematic structural diagram of another communication based train control CBTC system according to the present disclosure.

With reference to FIG. 7, based on the above embodiment, in the CBTC system according to the present disclosure, the setting module 0 may include a determining unit 01 and a setting unit 02.

The determining unit 01 is configured to determine at least one marshalling length and a minimum train running length which are allowed in a running line of the train.

The setting unit 02 is configured to set the screening area in the running line based on the at least one marshalling length and the minimum train running length. The screening area adjoins the CBTC area. At least one screening section respectively matching with the at least one marshalling length is set in the screening area, and each of the at least one screening section starts from an axle counting magnetic head located at an adjoining position where the screening area adjoins the CBTC area.

The first judging module 1 includes a calculating unit 11 and a first judging unit 12.

The calculating unit 11 is configured to receive a locomotive position transmitted by an on-board CBTC device of the train, and calculate a distance between the locomotive and the axle counting magnetic head.

The first determining unit 12 is configured to determine whether other vehicle exists in a train front section adjoining the screening area in the CBTC area in a case where the distance between the locomotive and the axle counting magnetic head is less than or equal to the minimum train running length, determine that other vehicle exists in front of the train in the running direction of the train in a case where other vehicle exists in the train front section, and determine that no vehicle exists in front of the train in the running direction of the train in a case where no vehicle exists in the train front section.

The determining module 2 includes a receiving unit 21, a collecting unit 22 and a matching unit 23.

The receiving unit 21 is configured to receive marshalling length information transmitted by the on-board CBTC device of the train.

The collecting unit 22 is configured to collect section length information of a screening section matching with the length of the train after the whole train enters into the screening area.

The matching unit 23 is configured to determine whether the marshalling length information matches with the section length information, and determine the marshalling length of the train based on the marshalling length information in a case where the marshalling length information matches with the section length information.

The second judging module 3 includes a setup unit 31 and a second judging unit 32.

The setup unit 31 is configured to, after the whole train enters into the screening area, determine a screening section matching with the marshalling length of the train in the screening area, and set a train rear section in the rear of the determined screening section. The length of the train rear section is equal to the minimum train running length.

The second judging unit 32 is configured to determine whether other vehicle exists in the train rear section, determine that other vehicle exists in the rear of the train in the running direction of the train in a case where other vehicle exists in the train rear section, and determine that no vehicle exists in the rear of the train in the running direction of the train in a case where no vehicle exists in the train rear section.

It should be noted that the communication based train control CBTC system according to the embodiment can use the control method for hybrid running of trains with different marshalling lengths according to the above method embodiment, and can be used to implement all technical solutions in the above method embodiment. A function of each functional module of the CBTC system may be implemented based on the method in the above method embodiment. For an implementation process of the functional module, reference may be made to the related description in the above embodiment, which is not described repeatedly herein.

As described above, the control method for hybrid running of trains with different marshalling lengths and the CBTC system are provided in the present disclosure. It is determined whether other vehicle exists in front of a train in a running direction of the train based on a preset screening area before the train runs into a communication based train control CBTC area. The marshalling length of the train is determined based on the screening area in a case where no vehicle exists in front of the train in the running direction of the train. It is determined whether other vehicle exists in the rear of the train in the running direction of the train based on the marshalling length of the train and the screening area. Movement authorization is provided for the train in a case where no vehicle exists in the rear of the train in the running direction of the train. It can be seen that, with the technical solution in the present disclosure, it is determined whether other vehicle exists in front of a train in a running direction of the train based on the set screening area before the trains with different marshalling lengths enter into the CBTC area, the marshalling length of the train is determined based on the screening area, and it is determined whether other vehicles exist in the rear of the train in the running direction of the train, thereby not only providing movement authorization for the train timely and quickly, but also supporting hybrid running of trains with different marshalling lengths, which can widen an application scope of the CBTC system.

Also, hybrid running of trains with multiple marshalling is supported in the present disclosure. A safe screening method is used at the boundary of the CBTC area (i.e. the transfer track or the connecting line), to make sure that no vehicle exists in front of/in the rear of the train and thus ensure safe running of the train in the CBTC area. In the present disclosure, the trackside CBTC device can quickly provide movement authorization for the on-board CBTC device, which facilitates upgrading a control stage and a driving mode of the on-board CBTC device, to meet an operation requirement of a large capacity and a high density. In the present disclosure, the trackside CBTC device may be configured to compare the length of the screening section occupied by the train with the marshalling length reported by the on-board CBTC device using a method based on axle counting, which can effectively prevent a safety accident caused due to incorrect length information or incorrect position information provided by the on-board CBTC device.

For the convenience of description, the above system is divided into various modules based on functions. In practice, functions of all modules may be implemented by a same or multiple software and/or hardware when implementing the present disclosure.

The embodiments in the specification are described in a progressive manner, with the emphasis of each of the embodiments on the difference from other embodiments. For the same or similar parts between the embodiments, reference may be made one to another. Since the system or the system embodiment is similar to the method embodiment, the description for the system or the system embodiment is simple, and reference may be made to the method embodiment for the relevant parts. The above system and the above system embodiment are only illustrative. The units described as separate components may be or may not be separated physically, and the components shown as units may be or may not be physical units, that is, the units may be located at the same position or may be distributed onto multiple network units. A part or all of the modules may be selected based on actual needs to implement the solution according to the embodiment. Those skilled in the art may understand and implement the present disclosure without creative work.

Those skilled in the art may further realize that, the units and the steps of the algorithm in each example described in conjunction with the disclosed embodiments of the present disclosure may be implemented with electronic hardware, computer software or a combination thereof. In order to clearly describe interchangeability of hardware and software, a composition and steps of each example have been described generally based on functions in the above description. Whether the function is implemented with hardware or software depends on a specific application and a design constraint of the technical solution. The described function may be implemented by those skilled in the art with different methods for specific applications, and the implementation should be considered to fall within the scope of the present disclosure.

Steps of the method or the algorithm described in conjunction with the embodiments disclosed herein may be implemented directly with hardware, a software module executed by a processor or a combination thereof. The software module may be provided in a Random Access Memory (RAM), a memory, a Read Only Memory (ROM), an electrically-erasable ROM, an electrically erasable programmable ROM, a register, a hard disk, a removable disk, a CD-ROM, or a storage medium in any other forms known in the art.

The above description of the embodiments enables those skilled in the art to implement or use the present disclosure. Multiple modifications to these embodiments are apparent to those skilled in the art, and the general principle defined herein may be implemented in other embodiments without deviating from the spirit or scope of the present disclosure. Therefore, the present disclosure is not limited to these embodiments described herein, and conforms to the widest scope consistent with the principle and novel features disclosed herein.

The invention claimed is:

1. A control method for hybrid running of trains with different marshalling lengths, comprising:

determining whether other vehicle exists in front of a train in a running direction of the train based on a preset screening area, before the train runs into a communication based train control CBTC area;

determining a marshalling length of the train based on the screening area in a case where no vehicle exists in front of the train in the running direction of the train; and determining whether other vehicle exists in the rear of the train in the running direction of the train based on the marshalling length of the train and the screening area, and providing movement authorization for the train in a case where no vehicle exists in the rear of the train in the running direction of the train.

2. The control method according to claim 1, wherein setting of the screening area comprises:

determining at least one marshalling length and a minimum train running length which are allowed in a running line of the train; and setting the screening area in the running line based on the at least one marshalling length and the minimum train running length, wherein the screening area adjoins the CBTC area, at least one screening section respectively matching with the at least one marshalling length is set in the screening area, and each of the at least one screening section starts from an axle counting magnetic head located at an adjoining position where the screening area adjoins the CBTC area.

3. The control method according to claim 2, wherein the determining whether other vehicle exists in front of the train in the running direction of the train based on the preset screening area comprises:

receiving a locomotive position transmitted by an on-board CBTC device of the train, and calculating a distance between the locomotive and the axle counting magnetic head;

determining whether other vehicle exists in a train front section adjoining the screening area in the CBTC area in a case where the distance between the locomotive and the axle counting magnetic head is less than or equal to the minimum train running length; and determining that other vehicle exists in front of the train in the running direction of the train in a case where other vehicle exists in the train front section, and determining that no vehicle exists in front of the train in the running direction of the train in a case where no vehicle exists in the train front section.

4. The control method according to claim 2, wherein the determining the marshalling length of the train based on the screening area comprises:

receiving marshalling length information transmitted by an on-board CBTC device of the train;

collecting section length information of the screening section matching with a length of the train after the whole train enters into the screening area; and determining whether the marshalling length information matches with the section length information, and determining the marshalling length of the train based on the marshalling length information in a case where the marshalling length information matches with the section length information.

5. The control method according to claim 2, wherein the determining whether other vehicle exists in the rear of the train in the running direction of the train based on the marshalling length of the train and the screening area comprises:

after the whole train enters into the screening area, determining the screening section matching with the marshalling length of the train in the screening area, and setting a train rear section in the rear of the determined screening section, wherein a length of the train rear section is equal to the minimum train running length;

determining whether other vehicle exists in the train rear section; and determining that other vehicle exists in the rear of the train in the running direction of the train in a case where other vehicle exists in the train rear section, and determining that no vehicle exists in the rear of the train in the running direction of the train in a case where no vehicle exists in the train rear section.

6. A communication based train control CBTC system, comprising:

a processor; and a memory storing processor-executable instructions;

wherein the instructions, when executed by the processor, configure the processor to:

determine whether other vehicle exists in front of a train in a running direction of the train based on a screening area preset by a setting module, before the train runs into a communication based train control CBTC area;

determine a marshalling length of the train based on the screening area in a case where no vehicle exists in front of the train in the running direction of the train; and determine whether other vehicle exists in the rear of the train in the running direction of the train based on the marshalling length of the train and the screening area, and provide movement authorization for the train in a case where no vehicle exists in the rear of the train in the running direction of the train.

7. The system according to claim 6, wherein the instructions, when executed by the processor, further configure the processor to:

determine at least one marshalling length and a minimum train running length which are allowed in a running line of the train; and set the screening area in the running line based on the at least one marshalling length and the minimum train running length, wherein the screening area adjoins the CBTC area, at least one screening section respectively matching with the at least one marshalling length is set in the screening area, and each of the at least one screening section starts from an axle counting magnetic head located at an adjoining position where the screening area adjoins the CBTC area.

8. The system according to claim 6, wherein the instructions, when executed by the processor, further configure the processor to:

receive a locomotive position transmitted by an on-board CBTC device of the train, and calculate a distance between the locomotive and an axle counting magnetic head; and determine whether other vehicle exists in a train front section adjoining the screening area in the CBTC area in a case where the distance between the locomotive and the axle counting magnetic head is less than or equal to the minimum train running length, determine that other vehicle exists in front of the train in the running direction of the train in a case where other vehicle exists in the train front section, and determine that no vehicle exists in front of the train in the running direction of the train in a case where no vehicle exists in the train front section.

9. The system according to claim 6, wherein the instructions, when executed by the processor, further configure the processor to:

receive marshalling length information transmitted by an on-board CBTC device of the train;

collect section length information of a screening section matching with a length of the train after the whole train enters into the screening area; and determine whether the marshalling length information matches with the section length information, and determine the marshalling length of the train based on the marshalling length information in a case where the marshalling length information matches with the section length information.

10. The system according to claim 6, wherein the instructions, when executed by the processor, further configure the processor to:

determine a screening section matching with the marshalling length of the train in the screening area after the whole train enters into the screening area, and set a train rear section in the rear of the determined screening section, wherein a length of the train rear section is equal to a minimum train running length; and determine whether other vehicle exists in the train rear section, determine that other vehicle exists in the rear of the train in the running direction of the train in a case where other vehicle exists in the train rear section, and determine that no vehicle exists in the rear of the train in the running direction of the train in a case where no vehicle exists in the train rear section.

* * * * *